United States Patent [19]

Tiebout

[11] Patent Number: 4,461,578

[45] Date of Patent: Jul. 24, 1984

[54] METHOD AND APPARATUS FOR AUTOMATICALLY STIRRING INSULIN

[76] Inventor: Robert H. Tiebout, 6443 Anguilla, Cypress, Calif. 90630

[21] Appl. No.: 432,338

[22] Filed: Oct. 1, 1982

[51] Int. Cl.[3] ..... B01F 9/02

[52] U.S. Cl. ..... 366/213; 366/348

[58] Field of Search ..... 366/208, 209, 211, 213, 366/214, 216, 217, 219, 232, 236, 602, 348

[56] References Cited

U.S. PATENT DOCUMENTS

| | | | |
|---|---|---|---|
| 1,855,658 | 4/1932 | Whipple et al. | 366/208 X |
| 2,599,852 | 6/1952 | McClain | 366/208 X |
| 3,086,332 | 4/1963 | Wentz | 366/232 X |
| 3,163,404 | 12/1964 | Kraft et al. | 366/214 |
| 3,291,454 | 12/1966 | Rosenblatt | 366/213 |
| 4,235,553 | 11/1980 | Gall | 366/208 |
| 4,277,185 | 7/1981 | Thompson | 366/213 |

*Primary Examiner*—Philip R. Coe

*Attorney, Agent, or Firm*—Charles H. Thomas

[57] ABSTRACT

An automatic insulin stirring device includes an electric motor mounted in a housing and coupled by speed reduction gearing to a horizontally disposed drive shaft. An insulin bottle receptacle is mounted in offset alignment on the drive shaft at an acute angle, preferably about 5°, relative to the drive shaft. A thumbscrew holds the insulin container in the receptacle and the motor rotates the drive shaft to simultaneously turn the insulin container in rotation and cyclically longitudinally rock the container relative to the drive shaft, thereby moving the insulin container ends in concentric orbits about the drive shaft axis. Automated stirring of the insulin suspension is achieved without generating bubbles in the insulin suspension and without the need for manual rolling of the insulin bottle.

2 Claims, 6 Drawing Figures

METHOD AND APPARATUS FOR AUTOMATICALLY STIRRING INSULIN

BACKGROUND OF THE INVENTION

1. Field of the Invention

The present invention relates to a method of stirring an insulin suspension prior to injection into a patient and to devices for stirring insulin dosages.

2. Description of the Prior Art

Insulin is an extract obtained from the pancreas of animals and which is extensively used in a liquid form for the treatment of diabetes. Insulin causes a reduction of sugar in the blood and urine of patients suffering from a disease of diabetes and thereby aids in allowing a diabetic patient to lead a relatively normal life. To sustain a normal lifestyle, a diabetic patient must receive periodic injections of insulin. Insulin is administered to diabetic patients either in a concentrated form or as a suspension in a liquid. When administered in a concentrated liquid form, insulin produces an immediate reduction in blood sugar level of relatively short duration. More typically, in long term treatment of diabetes, insulin is supplied in the form of a suspension of a pork derivative and zinc in a liquid, one form and concentration of which is known as U100. When injected into a patient, an insulin suspension of this type produces a less drastic, but more prolonged, reduction in blood sugar level.

Insulin suspensions are supplied both to hospitalized patients and as a prescription drug to patients who are not hospitalized. Dosages of insulin suspension are typically supplied in 10 cc bottles which are about one inch in diameter and about one and one-half inches in length. The bottles are closed by caps which may include a septum adapted to be pierced by a hypodermic needle to withdraw the insulin suspension from the bottle for injection into a patient.

Prior to injection of an insulin suspension dosage it is extremely important for the insulin suspension to be thoroughly mixed. Nevertheless, mixing must be performed without agitation, since bubbles would then form in the insulin. The injection of insulin containing bubbles into a patient could cause severe injury and pain to the patient.

To satisfactorily mix insulin suspensions prior to injection, a technique of rolling the insulin dosage bottle is typically employed. In using this technique, a person places a bottle containing an insulin suspension on its side on the palm of one hand and places the palm of the other hand on top of the other side of the insulin bottle in opposing fashion. The palms are then moved in reciprocating fashion and in opposite directions relative to each other while the person employing the technique tilts his hands together, first from one side and then to the other. This rolling technique to thoroughly mix the insulin suspension without creating bubbles in it must be continued for about five to ten minutes.

It is apparent that when the rolling technique is used to mix insulin, the hands and attention of a person are completely occupied during the five to ten minute mixing procedure. In hospitals, rolling is performed by nurses or nurses' aides and involves a considerable expenditure of time, greatly adding to the hospitalization costs of diabetic patients. Where insulin is administered to patients on an out-patient basis, the patient or someone else must spend valuable time performing the rolling technique.

SUMMARY OF THE INVENTION

In one aspect, the present invention is an automatic stirring device for stirring an insulin suspension to ensure a homogeneous dosage to a diabetic patient. The device employs a housing, an electric motor mounted within the housing, and a horizontally disposed drive shaft coupled to the electric motor, preferably through speed reduction gearing. The drive shaft protrudes through the housing and a liquid container receptacle is mounted at an angle on the drive shaft externally of the housing. Preferably, the liquid container receptacle is offset from alignment with the drive shaft by between about 0.5° and about 15°, the most desirable angle being about 5°. The liquid container receptacle defines a well with an open end into which a standard insulin suspension dosage bottle can be inserted on its side.

In another aspect, the present invention is a method for stirring an insulin suspension in a container. According to the method of the invention, a standard 10 cc insulin suspension bottle is placed on its side in the well of the receptacle which is mounted on a drive shaft and which maintains the insulin suspension container offset at an acute angle relative to alignment with the drive shaft. Once the insulin suspension container has been placed into the receptacle, it is immobilized therein by a locking mechanism. The drive shaft is then rotated to thereby simultaneously turn the insulin suspension container in rotation and cyclically rock the container relative to the drive shaft.

The invention may be described with greater clarity and particularity by reference to the accompanying drawings.

DESCRIPTION OF THE EMBODIMENT AND METHOD

Figure 1:
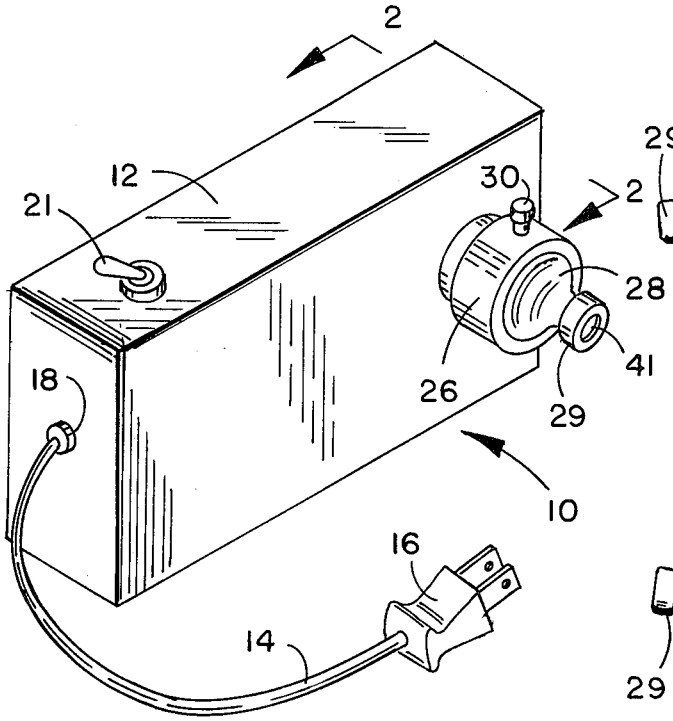
FIG. 1 is a perspective view of an automatic stirring device according to the invention.

FIGS. 1–5 illustrate an automatic stirring device 10 which includes a housing 12 formed generally in the shape of a rectangular prism. The stirring device 10 includes a conventional alternating current electrical cord 14 and plug 16. The electrical cord 14 enters the housing 12 through a grommet 18 and is electrically connected to a conventional 1750 RPM electrical motor 20, visible in FIG. 4. The electrical motor 20 is secured by mounting brackets within the housing 12. A toggle switch 21 is mounted on the top of the housing 12 and is connected in circuit with the electrical motor 20. The toggle switch 21 is used to switch the automatic stirring device 10 off and on. The electrical motor 20 is connected to series of spur gears interconnected to reduce the speed of rotation of the output of the motor 20. The speed reduction gearing is indicated at 22 in FIGS. 2 and 4. The speed reduction gearing 22 is connected to the output shaft of the motor 20 and terminates in a horizontally disposed drive shaft 24.

Figure 2:
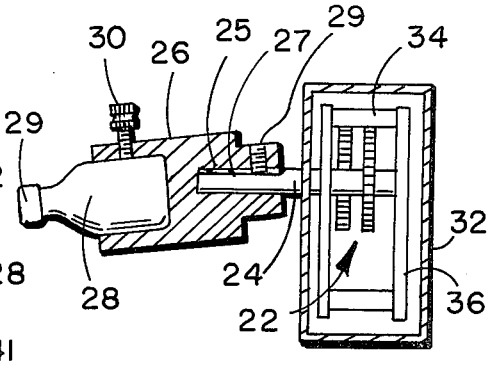
FIG. 2 is a sectional view taken along the lines 2—2 in FIG. 1 and illustrates an insulin bottle at one position of rotation of the drive shaft.

A cup shaped liquid container receptacle 26 is mounted at an acute angle on the drive shaft 24, as best depicted in FIG. 2. The cup-shaped receptacle 26 is of a generally cylindrical configuration and at one end defines a non-axial mounting hole 25 for receiving the end of the driven shaft 24. A chordal flat 27 is defined on the extremity of the drive shaft 24. The drive shaft 24 and the receptacle 26 are locked for rotation together by a set screw 29 which is threadably engaged in a transverse tapped bore through the receptacle 26 and which is tightened to bear against the flat 27.

The cup-shaped liquid container receptacle 26 defines a concave, cylindrical well, one end of which is open. The receptacle 26 receives a conventional 10 cc insulin suspension dosage bottle 28 and maintains the bottle 28 offset from alignment with the drive shaft 24 at an acute angle of between about 0.5° and about 15°. A thumbscrew 30 having an externally threaded shaft is threadably engaged in a transverse, tapped bore through the wall of the liquid container receptacle 26. The thumbscrew 30 thereby serves as a means for immobilizing the liquid containing bottle 28 relative to the receptacle 26.

The housing 12 may be formed as a molded, plastic case having five sides, the back being open to provide for installation and servicing of the operating components. The back of the housing 12 is closed by a flat backing panel 32 by means of screws or other conventional fasteners.

The electric motor 20 is preferably a conventional light duty, alternating current motor. A motor of 1/16 horse power operable by a 60 hertz, 115 volt commercially available power supply will suffice. The rotary output of the motor 20 serves as an input to the speed reduction gear train 22. The speed reduction gearing 22 is carried in a metal frame 34 having two flat, parallel bearing plates 36. The speed reduction gearing 22 includes several spur gears meshed together and culminating in an elongated, rod-like output drive shaft 24 which extends through an aperture in the face of the housing 12.

The drive shaft 24 is driven by the speed reduction gearing 22 at a speed of between 40 and 100 revolutions per minute. The speed is preferably about 60 revolutions per minute. The acute angle formed between the drive shaft 24 and the cup-shaped receptacle 26 is determined by the degree to which the shaft mounting hole 25 departs from axial alignment in the receptacle 26.

The cup-shaped receptacle 26 may also be a molded plastic structure and at the end opposite the mounting hole 25 a well is formed which is adapted to receive a standard 10 cc insulin suspension dosage bottle 28. At the opposite end of the receptacle 26, a narrow mounting hole 25 is defined, but not axially along the receptacle 26. Rather, the mounting hold 25 is formed at a slight angle relative to the axis of the receptacle 26. The angle of the mounting hole 25 relative to the receptacle axis is between about 0.5° and about 15°, and preferably is about 5°.

A person wishing to automatically stir an insulin suspension, or any other drug in the automatic stirring device 10 of the invention must first place the insulin suspension bottle 28 on its side and insert it into the well defined in the insulin container receptacle 26. While most insulin suspension dosage bottles 28 are of the standard 10 cc size the well is big enough to accommodate bottles of larger size, and the thumbscrew 30 ensures that regardless of size, the bottle 28 will remain immobilized within the liquid container receptacle 26.

Figure 3:
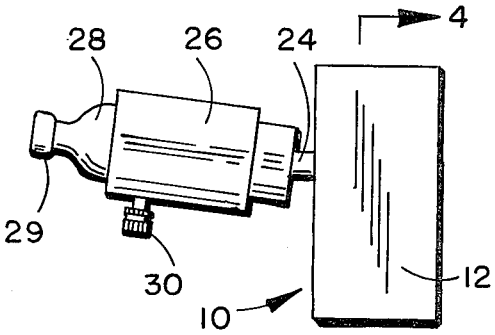
FIG. 3 is an end view of the automatic stirring device and illustrates the insulin bottle when the drive shaft has been rotated 180° relative to the position depicted in FIG. 2.
Figure 5:
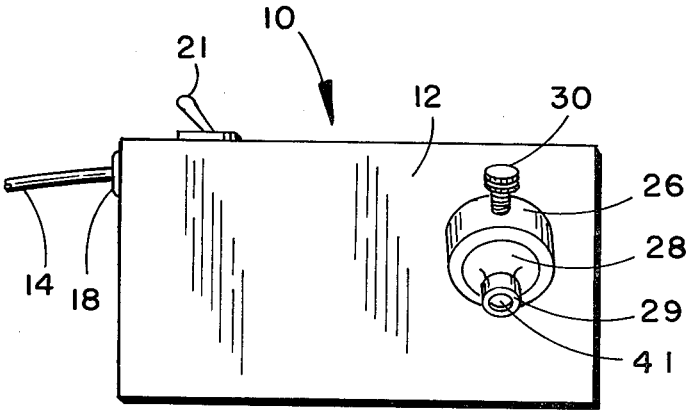
FIG. 5 is a front elevational view of the automatic stirring device with the drive shaft in the position depicted in FIG. 2.
Figure 4:
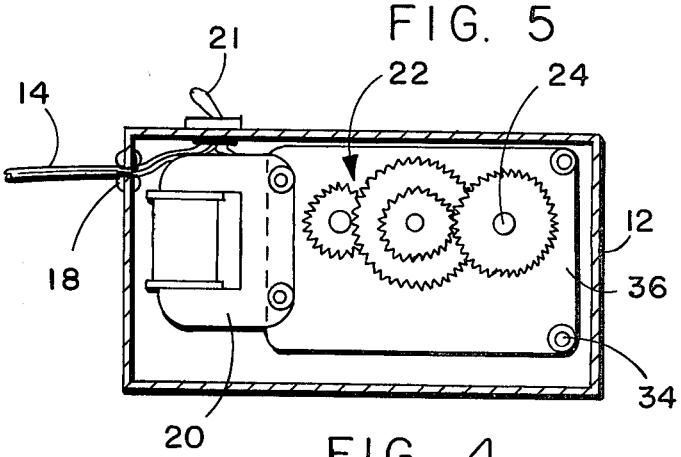
FIG. 4 is a sectional view of the automatic stirring device taken along the lines 4—4 of FIG. 3.

Once the bottle 28 has been inserted into the liquid container receptacle 26, as depicted in FIG. 2, the toggle switch 21 is operated, thereby turning on the motor 20. The motor 20 drives the speed reduction gearing 22 to rotate the drive shaft 24. Due to the non-axial mounting of the liquid containing receptacle 26 on the drive shaft 24, actuation of the motor 20 does not drive the receptacle 26 in a simple rotational motion, but rather simultaneously turns the insulin container in rotation and cyclically rocks it relative to the drive shaft. That is, the cap 29 of the bottle 28 is first lowered, and then raised relative to the drive shaft 24, as depicted in FIGS. 2 and 3. This rocking motion ensures the homogeneous mixture of the contents of the insulin suspension dose bottle 28. However, the speed of rotation of the drive shaft 24 and the angle of misalignment of the receptacle 26 and drive shaft 24 is so small that there is no tendency for bubbles to form within the bottle 28. Rather, the movement imparted to the bottle 28 is an orbital movement which does not agitate the liquid in the bottle 28.

Figure 6:
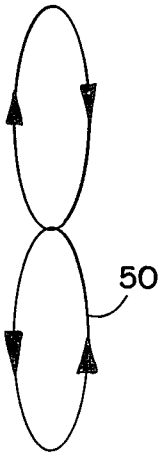
FIG. 6 is a front elevational diagram illustrating motion of the contents of a container during operation of the stirring device depicted in FIGS. 1–5.

The motion imparted to the liquid in the bottle 28 is illustrated diagramatically at 50 viewed along the axis of the drive shaft 24 in FIG. 6. The tendency for the contents of the bottle 28 to circulate in a figure-8 path ensures thorough and homogeneous mixture of the bottle contents.

The toggle switch 21 is left on while the drive shaft 24 turns and rocks the insulin bottle 28. No attention from any person is required during the five to ten minute interval that the switch 21 is left on to automatically stir the insulin. This is in contrast to the continuous attention required to the conventional "rolling" technique.

After the insulin has been stirred for five to ten minutes, the switch 21 is turned off and the thumbscrew 30 is loosened so that the insulin bottle 28 may be removed. A hypodermic needle is then used to penetrate a septum 41 across the mouth of the bottle 28 to withdraw insulin therefrom.

It can be seen that the automatic stirring device 10 of the invention effectuates a considerable savings in labor and eliminates any requirement for the tedious task of manually rolling an insulin bottle. The automatic stirring device 10 can be left unattended, and there are no adverse effects should the operator leave the switch 21 open for a period longer than required to effectuate thorough mixing of the insulin.

Undoubtedly, numerous variations and modifications of the invention are possible. For example, the automatic stirring device 10 could be equipped with a timer and an audible or visually perceptable signal to indicate to an operator that the contents of the insulin bottle 28 have been stirred sufficiently. Also, it is to be understood that the automated stirring device 10 can be used to mix any drug or other liquid suspension in which the suppression of formation of bubbles is required. Other modifications of the invention and different uses thereof will undoubtedly become readily apparent to those familiar with stirring devices and the preparation of insulin injections. Accordingly, the scope of the invention should not be construed as limited to the specific embodiment depicted and described nor to the specific implementation of the method of the invention, but rather is defined in the Claims appended hereto.

I claim:

1. A method for stirring an insulin suspension in a container comprising positioning said container of insulin suspension on its side in a receptacle which is mounted on a drive shaft and which maintains said insulin suspension container offset at an acute angle of between about 0.5° and about 15° relative to alignment with said drive shaft, and rotating said drive shaft at a speed of between about 40 and about 100 revolutions per minute to thereby simultaneously turn said insulin suspension container in rotation and cyclically rock said container relative to said drive shaft.

2. The method according to claim 1 further comprising moving said insulin container in an elliptical path.

* * * * *